United States Patent [19]

Fitzgerald

[11] Patent Number: 4,489,661

[45] Date of Patent: Dec. 25, 1984

[54] FOLDABLE TABLES AND THE LIKE

[76] Inventor: Patrick W. Fitzgerald, 17 Third Ave., Filton, Bristol, England

[21] Appl. No.: 367,596

[22] Filed: Apr. 12, 1982

[30] Foreign Application Priority Data

Apr. 12, 1981 [GB] United Kingdom ..... 8112797

[51] Int. Cl.[3] ..... A47B 3/00

[52] U.S. Cl. ..... 108/113; 108/99; 108/115

[58] Field of Search ..... 108/112, 113, 114, 115, 108/36, 99; 273/30

[56] References Cited

U.S. PATENT DOCUMENTS

| | | | |
|---|---|---|---|
| 2,645,539 | 7/1953 | Thompson | 108/113 |
| 2,978,754 | 4/1961 | Wilson . | |
| 3,080,833 | 3/1963 | Risdall | 108/112 |
| 3,212,463 | 10/1965 | Anderson et al. | 108/113 |
| 3,245,363 | 4/1966 | Amthor | 108/113 |
| 3,318,269 | 5/1967 | Kinn | 108/112 |
| 3,351,029 | 11/1967 | Bue | 108/112 |
| 4,027,600 | 7/1977 | Mueller | 108/113 |
| 4,133,271 | 1/1979 | Carlson | 108/113 |
| 4,327,650 | 5/1982 | Bue | 108/113 |

FOREIGN PATENT DOCUMENTS

| | | |
|---|---|---|
| 687394 | 7/1951 | United Kingdom . |
| 846366 | 8/1960 | United Kingdom . |
| 859978 | 6/1961 | United Kingdom . |
| 899554 | 6/1962 | United Kingdom . |
| 1110670 | 4/1968 | United Kingdom . |
| 1489795 | 10/1977 | United Kingdom . |
| 1521009 | 8/1978 | United Kingdom . |
| 2041216 | 10/1980 | United Kingdom . |

*Primary Examiner*—James T. McCall

*Attorney, Agent, or Firm*—William R. Hinds

[57] ABSTRACT

A foldable article such as a table has an upper surface member having two parts pivoted together at one edge to allow folding. Two sets of support means extend downwardly. They are arranged to be relatively longitudinally displaced by pivoting of the surface member's parts so that when the article is folded it is supported by one of the support means which bears transport means, e.g. rollers. Pivoting to the erected configuration transfers the support function to the other support means. One of the support means may be tubular, with the other received slidably therein. One is pivoted to the surface member adjacent the pivoted edge, while the other is connected to spaced regions of the member by pivoted struts.

6 Claims, 6 Drawing Figures

FOLDABLE TABLES AND THE LIKE

BACKGROUND OF THE INVENTION

The present invention relates to foldable furniture, and particularly to foldable tables and like collapsible structures.

Known foldable tables tend to be unstable when erected, so that it is all too apparent that they are indeed foldable structures and not permanent. For example, there is the trestle table, in which an upper surface member rests on independent foldable trestles. The surface member may be accidentally displaced relative to the trestles, or one or more of them may collapse. When dismantled, there are several separate components to be stored, and they can be quite bulky. There are also picnic tables of various types wherein a surface member has one or more structures articulated to it for providing legs. Such structures are inherently unstable, and only small units are practicable. The known tables are movable only by carrying or dragging. When folded, they are generally not self-supporting unless laid flat.

SUMMARY OF THE INVENTION

According to the present invention there is provided a foldable article of furniture comprising: an upper surface member having two sections which are mutually pivotally connected at or adjacent respective side edges so as to be mutually relatively pivotable between folded and erected configurations; first and second support means for the article, each extending downwardly generally beneath the surface member in the erected configuration, and being constructed and arranged so that said relative pivoting of the surface member's sections causes movement of said first and second support means relative to one another, such that pivoting between said folded and erected configurations alters the relative positions of the first and second support means from a first position in which substantial support is affordable by the first support means to a second position in which substantial support is affordable by the second support means.

Suitably, displacement means are coupled to at least one of the support means to effect said relative displacement.

Preferably the first support means has transport means (e.g. castors, rollers or skids) for engaging the ground in the first position. The folded article can thus be easily moved thereby. In the erected article the transport means may be clear of the ground, or only lightly in contact with it.

The first or second support means may include one or more upright tubular members through which the other support means extend slidably.

The second support means may be pivotally connected to the upper surface member adjacent the pivoted side edges. The first support means may be pivotally connected to at least one strut which is pivotally connected at its distal end to the upper surface member at a region spaced from the pivoted side edges.

The sections of the upper surface member may have auxiliary leg members remote from the pivoted edges for providing further support for the erected article. These may be pivotally mounted so as to be foldable against the sections to allow folding of the article.

A foldable table embodying the invention may have, when erected, the appearance and feeling of solidity of a permanent table, and yet be easily foldable into a slim unit of neat appearance. This can be easily moved, particularly if it has castors or rollers.

BRIEF DESCRIPTION OF THE DRAWING

FIG. 3 is an end elevation showing an early stage thereof; FIG. 4 is a perspective view at a later stage; and FIG. 5 is a view similar to that of FIG. 4 at a still later stage showing the pivoting of a leg member.

DESCRIPTION OF THE PREFERRED EMBODIMENT

Figure 1:
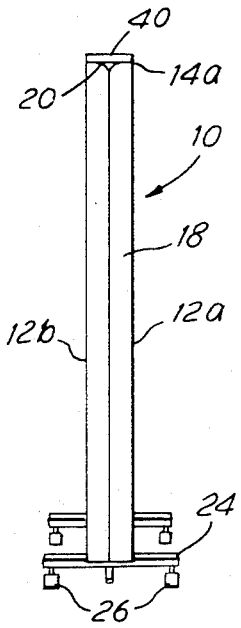
FIG. 1 is an end elevation of a table embodying the invention, in its fully-folded state.

The table 10 has a table top 12 composed of two like halves 12*a*,12*b* hinged together adjacent one edge 14*a*. Each of the halves has a relatively thin sheet 16 providing a work surface, with flanges 18 along the three unhinged edges 14*b*, *c* and *d*. The corners 20 of the flanges 18 adjacent the hinged edge 14*a* are rounded to allow relative pivoting of the halves 12*a* and 12*b*.

A central support 22 of the table comprises two like uprights 24, one adjacent each side of the table. Each upright 24 has the general form of an inverted 'T', the head 25 thereof extending generally horizontally and having castors or rollers 26 mounted adjacent each end. The upright limb 28 of each T-upright 24 is tubular, and extends through and a short way beneath the heat 25, terminating above the ground-engaging regions of the castors 26. A respective rod 30 is partially receivable telescopically within each limb 28. The rods 30 are pivotally connected to the table top 12 adjacent the hinged edges 14*a*. The upright limbs 28 are mutually connected by two generally horizontal cross-struts 32, 34, one adjacent the top ends, and one slightly above the heads 25. The lower cross-strut 32 has two pairs of struts 36 pivotally mounted, one pair adjacent each end. The upper ends of the struts 36 are pivoted to the table top halves intermediate the edges 14*a* and 14*c*.

Each table half 12*a*,*b* has a leg member 38 pivotally mounted nearer the free than the hinged end of the table half. The pivoting is limited by a strut 40 which is pivoted at one end to the table half 12*a* or *b* and passes through a slot in the leg member 38. The slot is bridged by a pin, which passes slidably through a slot in the strut 40. Abutment of the pin against an end of the strut's slot limits the outward pivoting.

Figure 2:
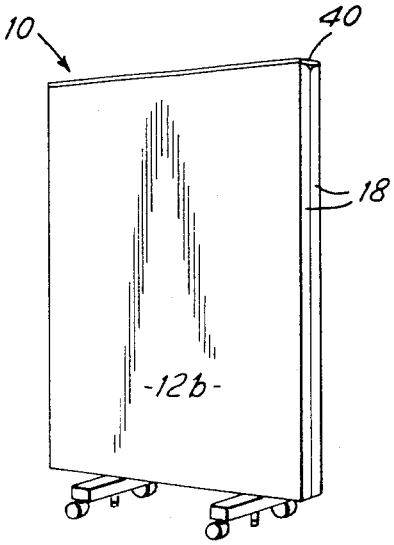
FIG. 2 is a perspective view of the folded table.
Figure 3:
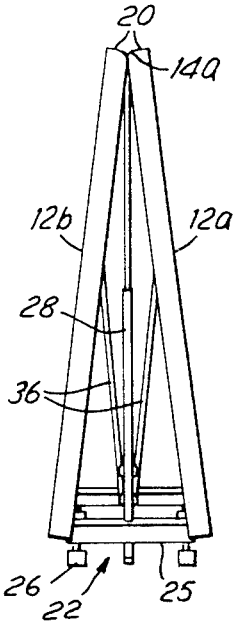
FIGS. 3 to 5 are views illustrating the erection of the table.
Figure 4:
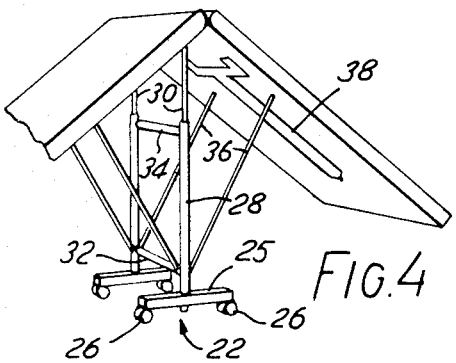

In the fully folded state (FIGS. 1 and 2), the table halves 12*a*,*b* are in overlying relationship, with corresponding flanges 18 in contact. The leg members 38 are pivoted flat against the table halves (see FIG. 4), and may be clipped in place. The folded table is very slim, its thickness being substantially twice that of the table top 12. Of course the support 22 has greater lateral extent, this being chosen to give adequate stability. The folded table can easily be moved on the castors 26. For neatness, a closure piece 40 may be fitted to the fully-folded table to close the gap at the unflanged edges 14*a*.

In order to erect the table, the closure piece 40 is first removed. Then, outward pivoting of the table halves 12*a* and *b* is commenced. As pivoting proceeds, the struts 36 diverge farther from the vertical. In consequence the rods 30 are pushed further downwardly within the tubular limbs 28 of the central supports 22.

Figure 5:
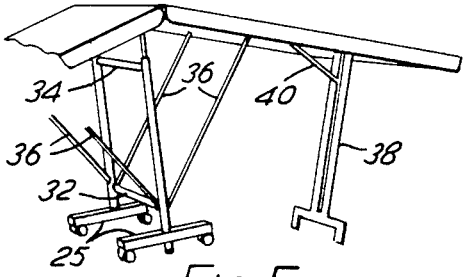
Figure 6:
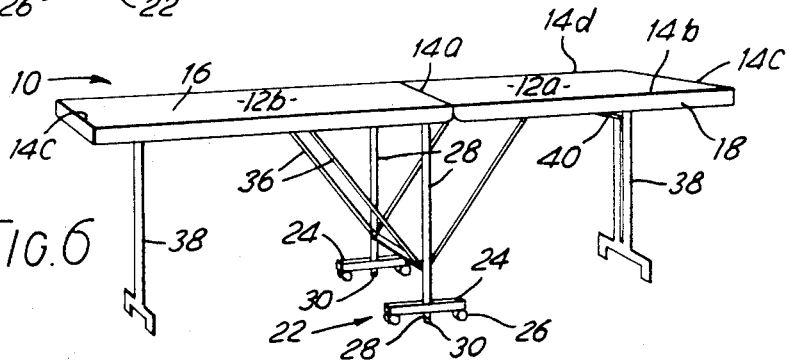
FIG. 6 is a perspective view of the fully erected table.

When the table halves 12*a* and *b* are approaching the horizontal (see FIG. 5), the leg members 38 are pivoted down (by hand) as far as the struts 40 will permit, i.e. until they are approximately perpendicular to their respective table halves 12*a,b*. Completion of the pivoting of the table halves, so that they become horizontal, causes the lower ends of the rods 30 to project beneath the tubular limbs 28 of the uprights 22 so that they engage the ground (e.g. having rubber feet for this purpose), and cause the castors 26 to be lifted from the ground. Thus the table as seen in FIG. 5 is supported on the two leg members 38 (each having two feet), and the two rods 30. This gives a very firm and steady table.

The pivoting of the table halves can be effected with little force because the pivot points of the struts 36 on the table halves 12*a,b* are placed to achieve substantial counterpoising.

While the invention has been illustrated above with reference to a preferred embodiment, it will be understood by those skilled in the art that various changes may be made without departing from the spirit and scope of the invention, and it is intended to cover all such changes and modifications by the appended claims.

I claim:

1. A foldable article of furniture comprising: an upper surface member which comprises two sections which are mutually pivotally connected adjacent respective side edges so as to be pivotable downwardly from an erected configuration to a folded configuration; first and second elongate support means for the article, each extending downwardly generally beneath the surface member and having a respective ground-engageable lower end portion, said first support means being pivotally connected adjacent its upper end region to the upper surface member adjacent said pivoted side edges thereof, and wherein one of said first and second support means comprises at least one upright tubular portion through which a respective portion of the other support means extends slidably; and at least one strut which is pivotally connected at respective spaced regions thereof firstly to the upper surface member at a region spaced from said pivoted side edges and secondly to said second support means; the first and second support means and the at least one strut being dimensioned and arranged so that in the erected configuration substantial support is afforded by the first support means, and downward pivoting of said sections of the upper surface member causes relative sliding of the first and second support means so that in the folded configuration substantial support is afforded by the second support means.

2. An article according to claim 1 wherein said second support means has transport means at its ground-engageable lower end portion, the arrangement being such that these engage the ground in the folded configuration to facilitate transport of the article.

3. An article according to claim 1 wherein said support means which comprises at least one upright tubular portion is said second support means.

4. An article according to claim 1 further including auxiliary leg members mounted to respective ones of said sections of the upper surface member at regions spaced from the pivoted side edges.

5. An article according to claim 1 wherein the sections of the upper surface member and the support means are constructed and arranged so that in the folded configuration the two sections are upright and substantially mutually superposed, with the support means substantially between them.

6. An article according to claim 1 which is a foldable table, said upper surface member providing a table top.

* * * * *